US008262181B2

(12) United States Patent
Oshima

(10) Patent No.: US 8,262,181 B2
(45) Date of Patent: Sep. 11, 2012

(54) FLUID EJECTION DEVICE AND FLUID EJECTING RECORDING DEVICE INCLUDING AN INVERSE FILTER CIRCUIT

(75) Inventor: Atsushi Oshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 195 days.

(21) Appl. No.: 12/821,339

(22) Filed: Jun. 23, 2010

(65) Prior Publication Data

US 2010/0328380 A1 Dec. 30, 2010

(30) Foreign Application Priority Data

Jun. 26, 2009 (JP) ..... 2009-152603

(51) Int. Cl.
*B41J 29/38* (2006.01)

(52) U.S. Cl. ..... 347/9; 347/10

(58) Field of Classification Search ..... 347/5, 9, 347/10, 12, 14
See application file for complete search history.

(56) References Cited

U.S. PATENT DOCUMENTS 7,244,007 B2 * 7/2007 Ishizaki ..... 347/5
2009/0066739 A1 3/2009 Tabata et al.

FOREIGN PATENT DOCUMENTS

JP 2002-237729 A 8/2002
JP 2005-329710 A 12/2005
WO 2007/083669 A1 7/2007

* cited by examiner

*Primary Examiner* — Juanita D Jackson
(74) *Attorney, Agent, or Firm* — Maschoff Gilmore & Israelsen

(57) ABSTRACT

A fluid ejection device includes, a modulator, a digital power amplifier, a low pass filter, and an inverse filter circuit, including, a delay device, a subtracter that subtracts an output signal of the delay device from a drive waveform signal, an amplifier adapted to amplify an output signal of the subtracter, an adder that adds an output signal of the amplifier and another input signal, a first switch adapted to perform switching so as to set either one of the drive waveform signal and an output signal of the adder to be an input signal of the delay device, a second switch adapted to perform switching so as to set either one of the drive waveform signal and the output signal of the delay device to be the another input signal of the adder, and a switch connection control section that controls the first switch and the second switch.

9 Claims, 10 Drawing Sheets

FLUID EJECTION DEVICE AND FLUID EJECTING RECORDING DEVICE INCLUDING AN INVERSE FILTER CIRCUIT

CROSS-REFERENCE TO RELATED APPLICATIONS

This Application claims priority under 35 U.S.C. 119 to Japanese Patent Application No. 2009-152603 filed on Jun. 26, 2009 which is hereby incorporated by reference in its entirety for all purposes.

BACKGROUND

1. Technical Field

The invention relates to a fluid ejection device for applying a drive signal to an actuator to thereby eject a fluid. The present invention is suitable for a fluid ejecting recording device adapted to print predetermined characters and images by ejecting microscopic droplets of fluids from nozzles of a fluid ejection head to form microscopic particles (dots) thereof on a print medium.

2. Related Art

Compared to an analog power amplifier for linearly driving a transistor pair push-pull-coupled to each other, a digital power amplifier (also often referred to as a class D amplifier) which switch-operates and power-amplifies switching elements push-pull-coupled is superior in efficiency, and is used in a wide range. In the case of using the digital power amplifier to, for example, output a drive signal to an actuator for ejecting a fluid from a nozzle of a fluid ejecting recording device, a modulator pulse-modulates a drive waveform signal forming the basis of the drive signal into a modulated signal, the digital power amplifier power-amplifies the modulated signal, a low pass filter filters the power-amplified modulated signal thus amplified, and then the resulting modulated signal is output as a drive signal. The low pass filter attenuates the frequency component of the pulse modulation. On this occasion, when the number of actuators to be driven is changed, the frequency characteristic of the filter composed of the low pass filter and the capacitance of the actuator varies, thus there might occur the case in which a desired drive signal fails to be obtained. Therefore, the inventor has provided an inverse filter, which is capable of obtaining a desired drive signal irrespective of the number of actuators to be driven, on the anterior stage of the modulator as described in international publication WO2007/083669.

However, in the fluid ejection device described in the document mentioned above, a plurality of inverse filters with transmission characteristics different from each other are provided and arranged in such a way that the inverse filters with different transmission characteristics are switched according to a number of actuators to be driven. Hence the corresponding number of circuits to the number of inverse filters are required, and therefore, the circuit size of the inverse filters becomes large.

SUMMARY

An advantage of some aspects of the invention is to provide a fluid ejection device easy to be configured and capable of obtaining a desired drive signal.

A fluid ejection device according to an aspect of the invention includes a modulator adapted to pulse-modulate a drive waveform signal forming a basis of a drive signal of an actuator to obtain a modulated signal, a digital power amplifier adapted to power-amplify the modulated signal to obtain a power-amplified modulated signal, a low pass filter adapted to filter the power-amplified modulated signal to obtain the drive signal, and an inverse filter circuit. The inverse filter circuit includes a delay device adapted to delay a phase of an input signal, a subtracter adapted to subtract an output signal of the delay device from the drive waveform signal, an amplifier adapted to amplify an output signal of the subtracter at a predetermined magnification ratio, an adder adapted to add an output signal of the amplifier and another input signal to each other, a first switch adapted to perform switching so as to set either one of the drive waveform signal and an output signal of the adder to be an input signal of the delay device, a second switch adapted to set either one of the drive waveform signal and the output signal of the delay device to be the another input signal of the adder, and a switch connection control section adapted to switch a connection state of the delay device with the first switch and the second switch, thereby switching the transmission characteristic of the inverse filter circuit to either one of a phase lead characteristic and a phase lag characteristic.

According to the fluid ejection device, switching between the first switch and the second switch changes the connection status of the delay device by switching transmission characteristics of the inverse filter circuit between phase lead and phase lag. Such configuration realizes a desired drive waveform without complication while keeping the inverse filter circuit compact.

Further, according to the present fluid ejection device, since there is adopted the configuration of switching the input of the delay device using the first switch and of switching the input of the adder using the second switch, the transmission characteristic of the inverse filter circuit can be switched to either one of the phase lead characteristic and the phase lag characteristic with a simple configuration.

Further, the switch connection control section couples the first switch to the drive waveform signal and couples the second switch to the drive waveform signal if the number of actuators to be driven is one of equal to or larger than a predetermined number. Further, the switch connection control section couples the first switch to the output signal of the adder and couples the second switch to the output signal of the delay device if the number of actuators to be driven is smaller than the predetermined number.

According to the present fluid ejection device, it is possible to switch the transmission characteristic of the inverse filter circuit to either one of the phase lead characteristic and the phase lag characteristic in accordance with the number of actuators to be driven.

Further, the switch connection control section controls a magnification ratio of the amplifier in accordance with the number of actuators to be driven.

According to the present fluid ejection device, it becomes possible to further improve the waveform accuracy of the drive signal.

A fluid ejection device according to another aspect of the invention includes a first filter circuit adapted to perform a desired filter process on a drive waveform signal, a modulator adapted to pulse-modulate a signal obtained by the filter process to form a modulated signal, a digital power amplifier adapted to power-amplify the modulated signal to obtain a power-amplified modulated signal, and a second filter circuit adapted to filter the power-amplified modulated signal to form a drive signal. The first filter circuit includes a delay device adapted to delay a phase of an input signal, a subtracter adapted to subtract an output signal of the delay device from the drive waveform signal, an amplifier adapted to amplify an output signal of the subtracter at a predetermined magnification ratio, an adder adapted to add one of the drive waveform signal and an output signal of the delay device to an output signal of the amplifier, a first switch adapted to input one of the drive waveform signal and an output signal of the adder to the delay device, and a second switch adapted to input one of the drive waveform signal and the output signal of the delay device to the adder.

The first filter circuit makes the delay device input the drive waveform signal using the first switch and makes the adder input the drive waveform signal using the second switch if a number of actuators to be driven is one of equal to or larger than a predetermined number.

The first filter circuit makes the delay device input the output signal of the adder using the first switch and makes the adder input the output signal of the delay device using the second switch if the number of actuators to be driven is smaller than the predetermined number.

Further, the desired filter process corresponds to a filter process of emphasizing a predetermined high-frequency band if a number of actuators to be driven is one of equal to or larger than a predetermined number.

Further, the desired filter process corresponds to a filter process of attenuating a predetermined high-frequency band if a number of actuators to be driven is smaller than a predetermined number.

BRIEF DESCRIPTION OF THE DRAWINGS

The invention will be described with reference to the accompanying drawings, wherein like numbers reference like elements.

DESCRIPTION OF EXEMPLARY EMBODIMENTS

Then, as an embodiment of the invention, the fluid ejection device applied to a fluid ejecting recording device will be explained.

Figure 1:
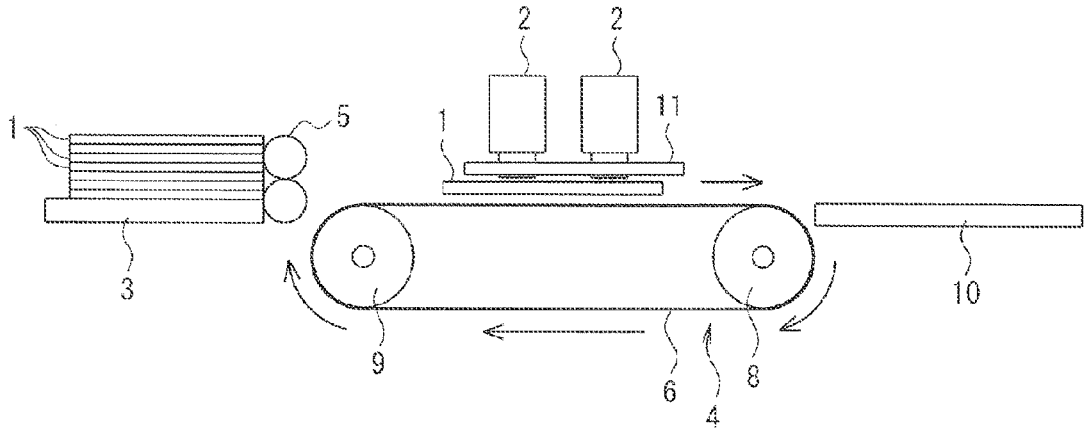
FIG. 1 is a front view of a schematic configuration showing a fluid ejecting recording device using a fluid ejection device as an embodiment of the invention.

FIG. 1 is a schematic configuration diagram of the fluid ejecting recording device according to the embodiment, and in FIG. 1, the fluid ejecting recording device is a line head printer in which a print medium 1 is conveyed in the arrow direction from the left to the right of the drawing, and printed in a printing area midway of conveying.

Figure 2:
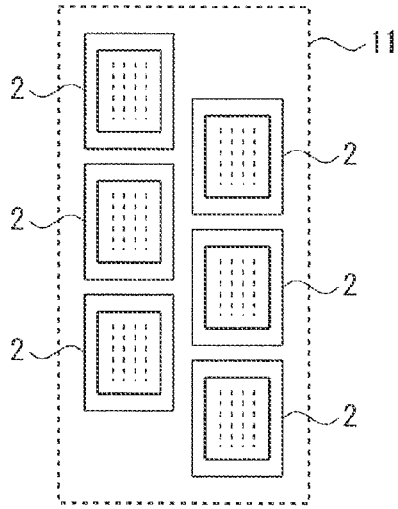
FIG. 2 is a plan view of the vicinity of fluid ejection heads used in the fluid ejecting recording device shown in FIG. 1.

The reference numeral 2 in FIG. 1 denotes a plurality of fluid ejection heads disposed above the convey line of the print medium 1. The fluid ejection heads are disposed so as to form two lines in the print medium conveying direction and to be arranged in a direction intersecting with the print medium conveying direction, and are fixed to a head fixing plate 11. Each of the fluid ejection heads 2 is provided with a number of nozzles. As shown in FIG. 2, the nozzles are arranged to form lines in a direction intersecting with the print medium conveying direction color by color in accordance with the colors of the fluid to be ejected, and the lines are called nozzle lines, and the direction of the lines is called a nozzle line direction. Further, the nozzle lines of all of the fluid ejection heads 2 arranged in a direction intersecting with the print medium conveying direction constitute a line head covering the overall width of the print medium in a direction intersecting with the conveying direction of the print medium 1. When the print medium 1 passes through under the nozzle surface of the fluid ejection head 2, the fluid is ejected from a number of nozzles provided to the nozzle surface to thereby perform printing on the print medium 1.

The fluid ejection head 2 is supplied with fluids such as ink of four colors of yellow (Y), magenta (M), cyan (C), and black (K) from fluid tanks not shown via fluid supply tubes. Then, a necessary amount of fluid is ejected simultaneously from the nozzles provided to the fluid ejection heads 2 to necessary positions, thereby forming fine dots on the print medium 1. By executing the above for each of the colors, one-pass printing can be performed only by making the print medium 1 to be conveyed by the conveying section 4 pass through once.

As a method of ejecting a fluid from the nozzles of the fluid ejection head 2, there can be cited electrostatic driving method, piezoelectric driving method, film boiling fluid ejection method, and so on, and in the present embodiment there is used the piezoelectric driving method. In the piezoelectric driving method, when a drive signal is applied to a piezoelectric element as an actuator, a diaphragm in a cavity vibrates to cause pressure variation in the cavity, and the fluid is ejected from the nozzle due to the pressure variation. Further, by controlling the wave height and the voltage of the drive signal, it becomes possible to control the ejection amount of the fluid. It should be noted that the invention can also be applied to fluid ejection methods other than the piezoelectric driving method in a similar manner.

Under the fluid ejection head 2, there is disposed the conveying section 4 for conveying the print medium 1 in the conveying direction. The conveying section 4 is configured by winding a conveying belt 6 around a drive roller 8 and a driven roller 9. The drive roller 8 is coupled to an electric motor not shown. In the inside of the conveying belt 6, there is disposed an adsorption device, not shown, for adsorbing the print medium 1 on the surface of the conveying belt 6. As the adsorption device there is used, for example, an air suction device for adsorbing the print medium 1 to the conveying belt 6 with negative pressure, or an electrostatic adsorption device for adsorbing the print medium 1 to the conveying belt 6 with electrostatic force. Therefore, when a feed roller 5 feeds just one sheet of the print medium 1 on the conveying belt 6 from a feeder section 3, and then the electric motor rotationally drives the drive roller 8, the conveying belt 6 is rotated in the print medium conveying direction, and the print medium 1 is conveyed while being adsorbed to the conveying belt 6 by the adsorption device. While the print medium 1 is conveyed, printing is performed by ejecting the fluid from the fluid ejection heads 2. The print medium 1 on which printing has been performed is ejected to a catch tray 10 disposed on the downstream side in the conveying direction. A print reference signal output device formed of, for example, a linear encoder is attached to the conveying belt 6. In the print reference signal output device, the conveying belt 6 and the print medium 1 conveyed while being adsorbed thereto are moved in sync with each other. After the print medium 1 passes through a predetermined position in the conveying path, a pulse signal equivalent to the required resolution is output in conjunction with the movement of the conveying belt 6. A drive circuit described later outputs a drive signal to the actuators 22 in accordance with the pulse signal, thereby ejecting the fluids of predetermined colors at predetermined positions on the print medium 1 to form dots, and a predetermined image is drawn on the print medium 1 with the dots.

Figure 3:
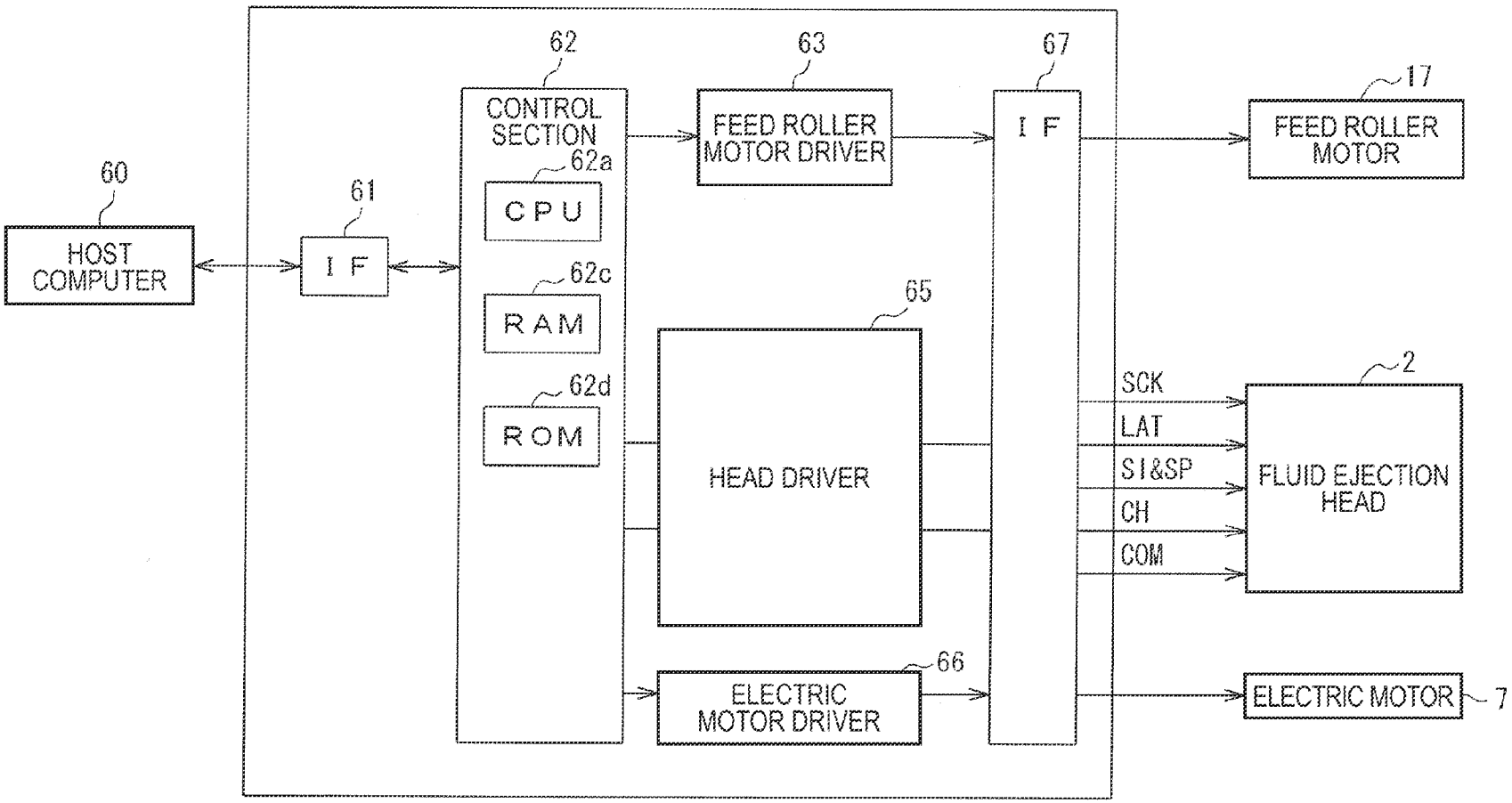
FIG. 3 is a block diagram of a control device of the fluid ejecting recording device shown in FIG. 1.

In the fluid ejecting recording device using the fluid ejection device of the present embodiment, there is provided a control device for controlling the fluid ejecting recording device. As shown in FIG. 3, the control device is configured including an input interface 61 for reading print data input from a host computer 60, a control section 62 configured with a microcomputer for executing an arithmetic processing such as a print process in accordance with the print data input from the input interface 61, a feed roller motor driver 63 for controlling driving of a feed roller motor 17 coupled to the feed roller 5, a head driver 65 for controlling driving of the fluid ejection heads 2, an electric motor driver 66 for controlling driving of an electric motor 7 coupled to the drive roller 8, and an interface 67 for connecting the feed roller motor driver 63, the head driver 65, and the electric motor driver 66, to the feed roller motor 17, the fluid ejection heads 2, and the electric motor 7, respectively.

The control section 62 is provided with a central processing unit (CPU) 62*a* for performing various processes such as a printing process, a random access memory (RAM) 62*c* for temporarily storing the print data input via the input interface 61 and various kinds of data used when performing the printing process of the print data, and for temporarily developing a program of the printing process, and a read-only memory (ROM) 62*d* formed of a nonvolatile semiconductor memory and for storing the control program executed by the CPU 62*a*. When the control section 62 obtains the print data (image data) from the host computer 60 via the input interface 61, the CPU 62*a* executes a predetermined process on the print data to obtain nozzle selection data (drive pulse selection data) representing which nozzle the fluid is ejected from or how much fluid is ejected. Based on the print data, the drive pulse selection data, and input data from various sensors, drive signals and control signals are output to the feed roller motor driver 63, the head driver 65, and the electric motor driver 66. In accordance with these drive signals and control signals, the feed roller motor 17, the electric motor 7, actuators 22 inside the fluid ejection head 2, and so on operate, thus feeding, conveying, and ejection of the print medium 1, and the printing process to the print medium 1 are executed. It should be noted that the constituents inside the control section 62 are electrically connected to each other via a bus not shown in the drawings.

Figure 4:
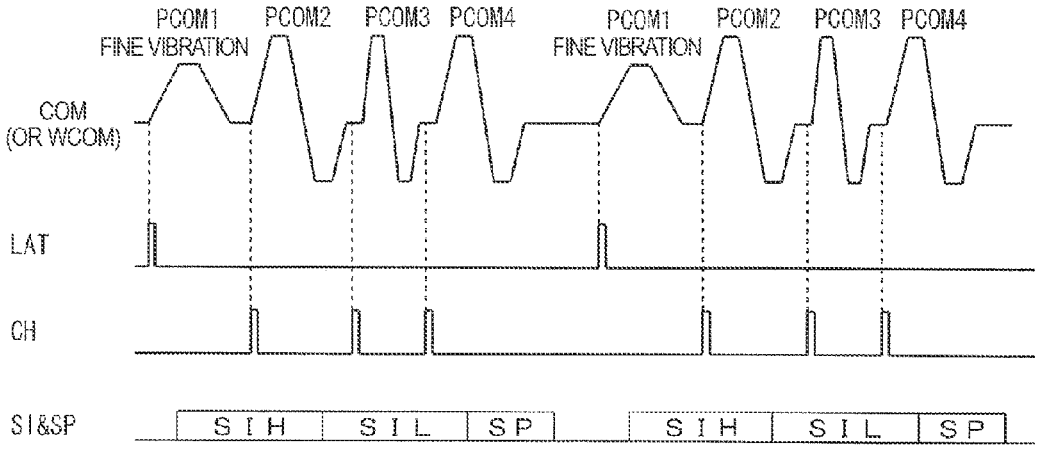
FIG. 4 is an explanatory diagram of a drive signal for driving actuators in each of the fluid ejection heads.

FIG. 4 shows an example of the drive signal COM supplied from the control device of the fluid ejecting recording device using the fluid ejection device according to the present embodiment to the fluid ejection heads 2, and for driving the actuators 22 each formed of a piezoelectric element. In the first embodiment, it is assumed that the signal has an electric potential varying around a midpoint potential. The drive signal COM is obtained by connecting drive pulses PCOM, each of which is a unit drive signal for driving the actuator 22 to eject the fluid, in a time-series manner. The rising portion of the drive pulse PCOM corresponds to a stage of expanding the volume of the cavity (a pressure chamber) communicating with the nozzle to pull in (in other words, to pull in the meniscus, in view of the ejection surface of the fluid) the fluid. The falling portion of the drive pulse PCOM corresponds to a stage of shrinking the volume of the cavity to thereby push-out (in other words, to push-out the meniscus, in view of the ejection surface of the fluid) the fluid. As a result of pushing out the fluid, the fluid is ejected from the nozzle.

By changing the voltage variation gradient and the wave height of the drive pulse PCOM formed of a trapezoidal voltage wave, it is possible to change a pull-in amount and a pull-in speed of the fluid, and a push-out amount and a push-out speed of the fluid. Thus, it becomes possible to vary the ejection amount of the fluid to obtain dots with different sizes. Therefore, even in the case in which a plurality of drive pulses PCOM is connected in a time-series manner, it is possible to select the single drive pulse PCOM from the drive pulses, and to supply the actuator 22 with the drive pulse PCOM to eject the fluid, or to select two or more drive pulses PCOM, and to supply them to the actuator 22 to eject the fluid two or more times, thereby obtaining the dots with various sizes. In other words, when the two or more droplets land on the same position before the droplets are dried, it brings substantially the same result as in the case of ejecting a larger amount of droplet, thus it is possible to increase the size of the dot. By a combination of such technologies, it becomes possible to achieve multiple tone printing. It should be noted that the drive pulse PCOM1 shown in the left end of FIG. 4 is only for pulling in the fluid without pushing it out. This is called a fine vibration, and is used for preventing thickening in the nozzle without ejecting the fluid.

Besides the drive signal COM, the drive pulse selection data SI&SP, a latch signal LAT, a channel signal CH, and a clock signal SCK are input to the fluid ejection head 2 from the control device shown in FIG. 3 as the control signals. The drive pulse selection data SI&SP is used for selecting the nozzle ejecting the fluid based on the print data, and at the same time, determining the connection timing of the actuators 22 such as piezoelectric elements to the drive signal COM. The latch signal LAT and the channel signal CH connect the drive signal COM and the actuator 22 of the fluid ejection head 2 based on the drive pulse selection data SI&SP after the nozzle selection data is input to all of the nozzles. The clock signal SCK is used for transferring the drive pulse selection data SI&SP to the fluid ejection head 2 as a serial signal. It should be noted that it is hereinafter assumed that the minimum unit of the drive signal for driving the actuator 22 is the drive pulse PCOM, and the entire signal having the drive pulses PCOM joined with each other in a time-series manner is described as the drive signal COM. In other words, output of a string of drive signal COM is started in response to the latch signal LAT, and the drive pulse PCOM is output in response to each channel signal CH.

Figure 5:
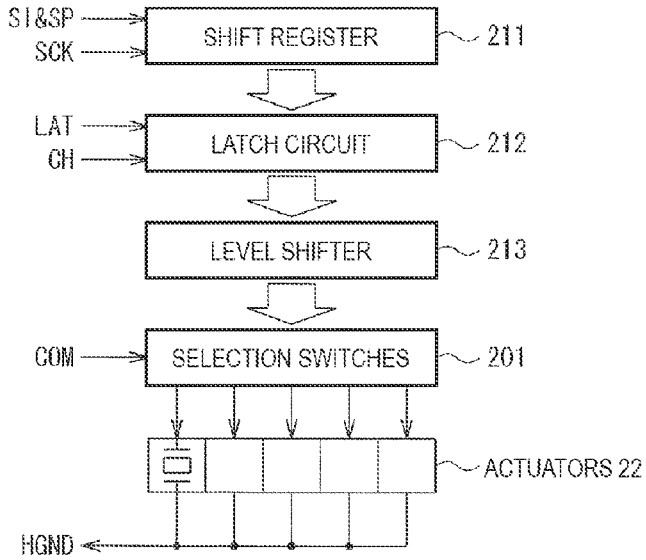
FIG. 5 is a block diagram of a switching controller.

FIG. 5 shows a configuration of a switching controller, which is built inside the fluid ejection head 2 in order for supplying the actuator 22 with the drive signal COM (the drive pulses PCOM). The switching controller is configured including a shift register 211, a latch circuit 212, and a level shifter 213. The shift register 211 stores the drive pulse selection data SI&SP for designating the actuators 22 such as piezoelectric elements corresponding to the nozzles for ejecting the fluid. The latch circuit 212 temporarily stores the data of the shift register 211. The level shifter 213 performs level conversion on the output of the latch circuit 212, and then supplies the result to a selection switch 201, thereby connecting the drive signal COM to the actuators 22 such as piezoelectric elements.

The drive pulse selection data signal SI&SP is sequentially input to the shift register 211, and the storage area is sequentially shifted from the first stage to the subsequent stage in accordance with the input pulse of the clock signal SCK. The latch circuit 212 latches the output signals of the shift register 211 in accordance with the latch signal LAT input thereto after the drive pulse selection data SI&SP corresponding to the number of nozzles has been stored in the shift register 211. The signals stored in the latch circuit 212 are converted by the level shifter 213 so as to have the voltage levels capable of switching on and off the selection switches 201 on the subsequent stage. This is because the drive signal COM has a relatively high voltage compared to the output voltage of the latch circuit 212, and the operating voltage range of the selection switches 201 is also set to be high in accordance therewith. Therefore, the actuator 22 such as a piezoelectric element, the selection switch 201 of which is closed by the level shifter 213, is coupled to the drive signal COM (the drive pulses PCOM) at the coupling timing of the drive pulse selection data SI&SP. Further, after the drive pulse selection data SI&SP of the shift register 211 is stored in the latch circuit 212, the subsequent print information is input to the shift register 211, and the stored data in the latch circuit 212 is sequentially updated in sync with the fluid ejection timing. It should be noted that the reference symbol HGND in the drawing denotes the ground terminal for the actuators 22 such as piezoelectric elements. Further, even after the actuator 22 such as the piezoelectric element is separated from the drive signal COM (the drive pulses PCOM) by the selection switch 201, the input voltage of the actuator 22 is maintained at the voltage applied thereto immediately before it is separated.

Figure 6:
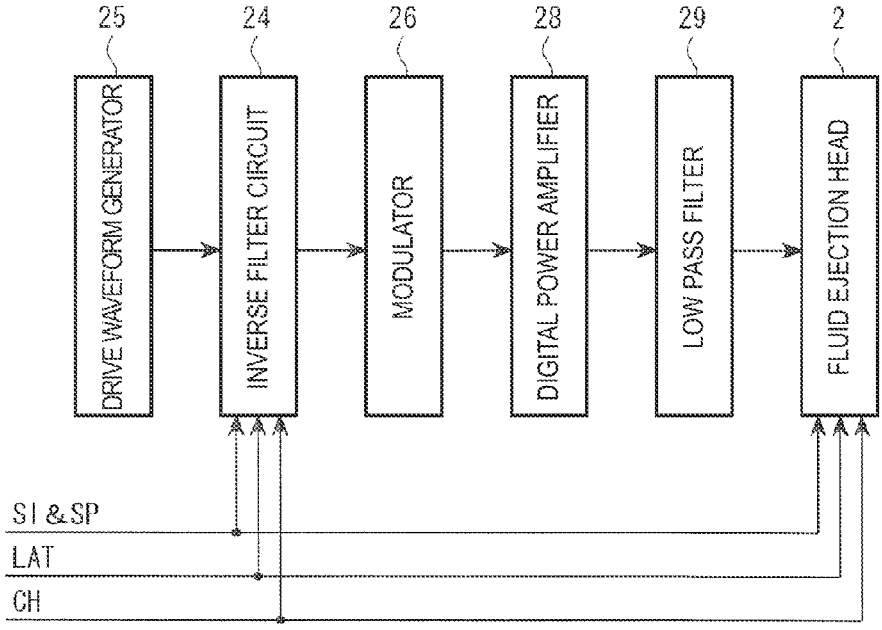
FIG. 6 is a block diagram showing an example of a drive circuit of the actuators.

FIG. 6 shows a schematic configuration of the drive circuit for the actuators 22. The actuator drive circuit is built inside the control section 62 and the head driver 65 included in the control circuit. The drive circuit of the present embodiment is configured including a drive waveform generator 25, an inverse filter circuit 24 (a first filter circuit), a modulator 26, a digital power amplifier 28, and the low pass filter 29 (a second filter circuit). The drive waveform generator 25 generates a basis of the drive signal COM (the drive pulses PCOM), namely a drive waveform signal WCOM forming a basis of the signal for controlling the drive of the actuator 22 based on the drive waveform data DWCOM stored previously. The inverse filter circuit 24 (the first filter circuit) performs an inverse filter process on the drive waveform signal WCOM generated by the drive waveform generator 25. The modulator 26 performs the pulse modulation on an inverse filter-processed drive waveform signal FWCOM on which the inverse filter process is performed by the inverse filter circuit 24. The digital power amplifier 28 power-amplifies the modulated signal pulse-modulated by the modulator 26. The low pass filter 29 (the second filter circuit) filters the power-amplified modulated signal power-amplified by the digital power amplifier 28, and then supplies the result to the fluid ejection heads 2 as the drive signal COM (the drive pulses PCOM). The drive signal COM (the drive pulses PCOM) is supplied from the selection switches 201 to the actuators 22.

The drive waveform generator 25 converts the drive waveform data DWCOM output from the CPU 62*a* into a voltage signal and holds it for a predetermined sampling period, and then performs analog conversion thereon with a D/A converter, and then outputs the result as the drive waveform signal WCOM.

Figure 7:
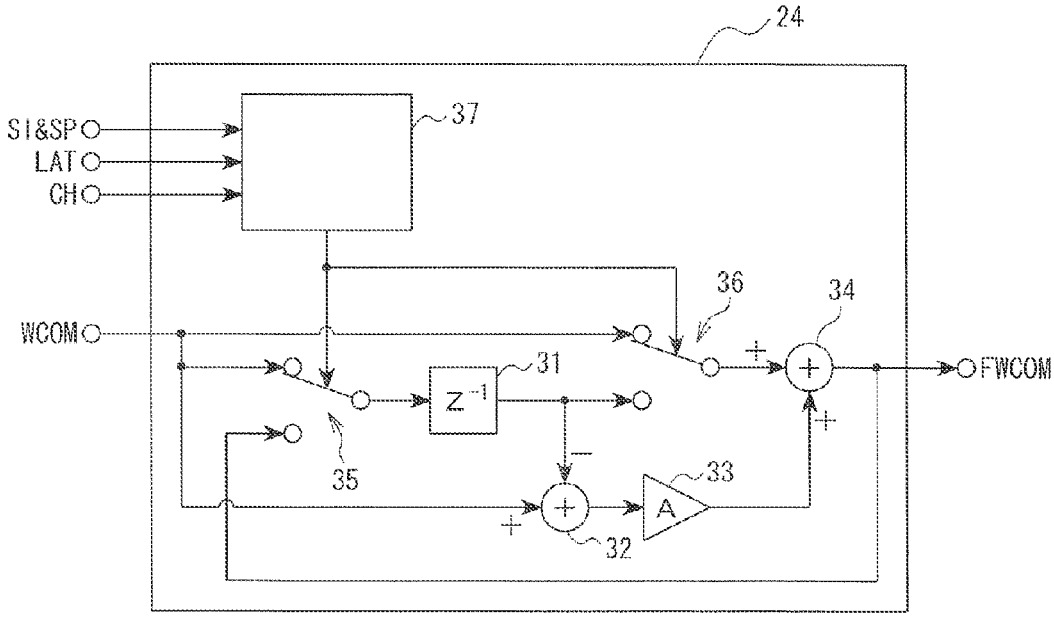
FIG. 7 is a block diagram of an inverse filter circuit shown in FIG. 6.

As shown in FIG. 7, the inverse filter circuit 24 is provided with a delay device 31, a subtracter 32, an amplifier 33, an adder 34, a first switch 35, a second switch 36, and a switch connection control section 37. The subtracter 32 subtracts the output of the delay device 31 from the drive waveform signal WCOM. The amplifier 33 amplifies the output of the subtracter 32 at a predetermined magnification ratio. The adder 34 adds the output of the amplifier 33 and another input, and outputs the result as the inverse filter-processed drive waveform signal FWCOM. The first switch 35 switches the drive waveform signal WCOM and the output of the adder 34 to form an input of the delay device 31. The second switch 36 switches the drive waveform signal WCOM and the output of the delay device 31 to form another input of the adder 34. The switch connection control section 37 controls the switching connection between the first switch 35 and the second switch 36. Among these elements, the switch connection control section 37 reads the drive pulse selection data SI&SP, the latch signal LAT, and the channel signal CH, and performs the switching connection control of the first switch 35 and the second switch 36 in accordance with the number of the actuators 22 to be driven. It should be noted that when connecting the first switch 35 to the drive waveform signal WCOM, the second switch 36 is also connected to the drive waveform signal WCOM. When connecting the first switch 35 to the output of the adder 34, the second switch 36 is connected to the output of the delay device 31. Thus, the transmission characteristic of the inverse filter circuit 24 is switched between a phase lead characteristic and a phase lag characteristic, and the control thereof will be described later in detail. It should be noted that the switch connection control section 37 can be built with a program executed in the control section 62 or can be built with a program executed in the switch connection control section 37.

Figure 8:
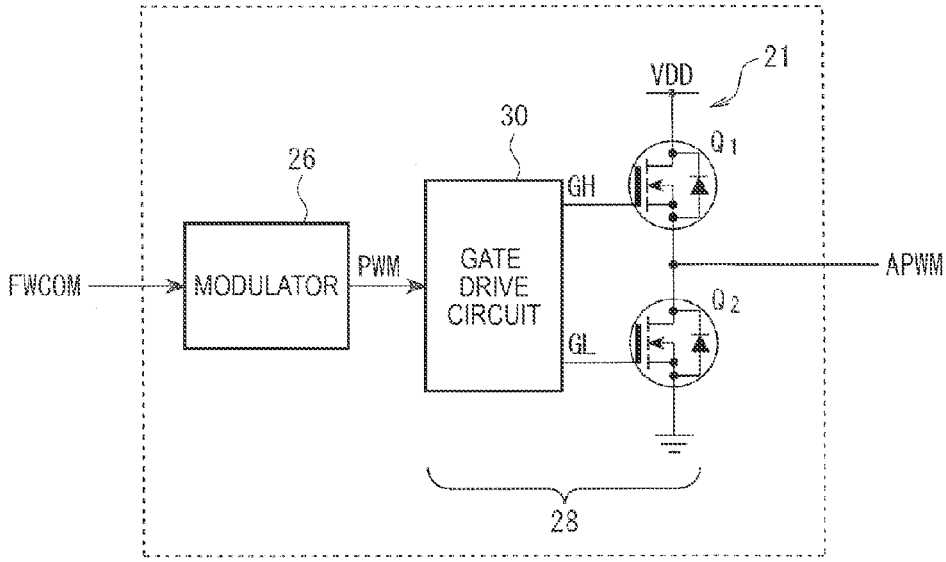
FIG. 8 is a block diagram of a digital power amplifier shown in FIG. 6.

As shown in FIG. 8, as the modulator 26 for performing pulse modulation on the inverse filter-processed drive waveform signal FWCOM on which the inverse filter process is performed in the inverse filter circuit 24, there is used a well-known pulse width modulation (PWM) circuit. In the pulse width modulation, a reference signal such as a triangular wave signal or a saw-tooth wave with a predetermined frequency and an input signal (in this case, the inverse filter-processed drive waveform signal FWCOM) are compared with each other, and the modulated signal with a pulse duty cycle in which the on-duty represents that the inverse filter-processed drive waveform signal FWCOM is higher than the reference signal is output. It should be noted that the frequency of the reference signal is defined as a modulation frequency (called, in general, a carrier frequency, for example). Further, as the modulator 26, there can be used a well-known pulse modulator such as a pulse density modulator (PDM) besides the above.

The digital power amplifier 28 is configured including a half-bridge output stage 21 and a gate drive circuit 30. The half-bridge output stage 21 is composed of a high-side switching element Q1 and a low-side switching element Q2 for substantially amplifying the power. The gate drive circuit 30 controls the gate-source signals GH, GL of the high-side switching element Q1 and the low-side switching element Q2 based on the modulated signal from the modulator 26. In the digital power amplifier 28, when the modulated signal is in the high level, the gate-source signal GH of the high-side switching element Q1 becomes in the high level, while the gate-source signal GL of the low-side switching element Q2 becomes in the low level. Therefore, since the high-side switching element Q1 is set to be in a connected state (on state) and the low-side switching element Q2 is set to be in an unconnected state (off state), and as a result, the output of the half-bridge output stage 21 becomes equal to a supply voltage VDD. On the other hand, when the modulated signal is in the low level, the gate-source signal GH of the high-side switching element Q1 becomes in the low level, while the gate-source signal GL of the low-side switching element Q2 becomes in the high level. Therefore, the high-side switching element Q1 is set to be in the off state and the low-side switching element Q2 is set to be in the on state, and as a result, the output of the half-bridge output stage 21 becomes 0.

In the case in which the high-side switching element Q1 and low-side switching element Q2 are driven digitally as described above, although a current flows through the switching element in the on state, the resistance value between the drain and the source is small, and therefore, the loss is hardly caused. Further, since no current flows in the switching element in the off state, no loss is caused. Therefore, the loss itself of the digital power amplifier 28 is extremely small, and therefore, it is possible to use small-sized switching elements such as MOSFETs.

Figure 9:
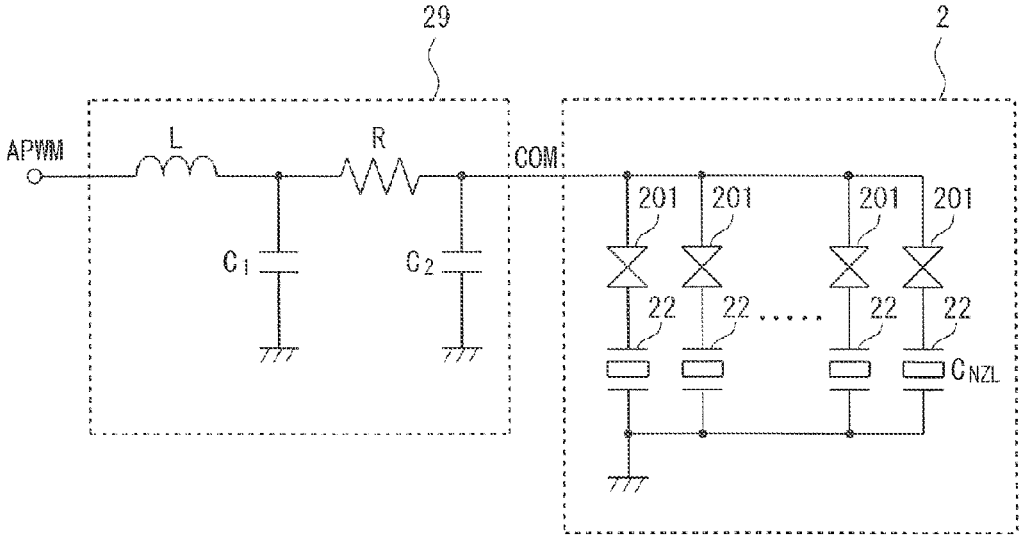
FIG. 9 is a block diagram of a low pass filter shown in FIG. 6.

As shown in FIG. 9, a three-dimensional filter composed of two capacitors $C_1$, $C_2$, a coil L, and a resister R is used as the low pass filter 29. The modulation frequency generated by the modulator 26, namely the frequency component of the pulse modulation, is attenuated to be removed (filtered out) by the low pass filter 29, and then the drive signal COM (the drive pulses PCOM) having the waveform characteristic described above is output.

The piezoelectric element as the actuator 22 is a capacitive element, and each of the actuators 22 has a predetermined capacitance $C_{NZL}$. Since the actuators 22 driven for ejecting the fluid are coupled to the drive circuit by the selection switches 201, the capacitance of the second capacitor $C_2$ varies equivalently in accordance with the number of actuators 22 to be driven. Specifically, the transfer function T(s) of the filter composed of the low pass filter 29 and the capacitance $C_{NZL}$, of the actuators 22 to be driven is expressed by the Formula (1) below. In the formula (1), the symbol $N_{NZL}$, denotes the number of actuators 22 to be driven, and the symbol "s" denotes a Laplace operator.

$$T(s) = \frac{\dfrac{1}{LRC_1(C_2 + C_{NZL} \times N_{NZL})}}{s^3 + \dfrac{C_1 + (C_2 + C_{NZL} \times N_{NZL})}{RC_1(C_2 + C_{NZL} \times N_{NZL})}s^2 + \dfrac{1}{LC_1}s + \dfrac{1}{LRC_1(C_2 + C_{NZL} \times N_{NZL})}} \quad (1)$$

Figure 10:
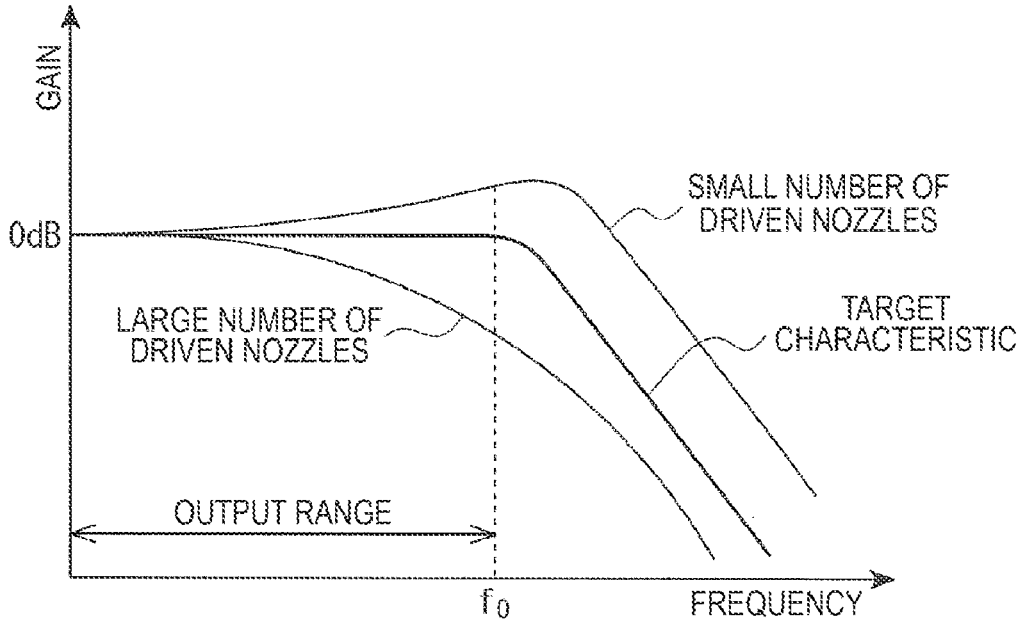
FIG. 10 is an explanatory diagram of the frequency characteristic of a filter composed of the low pass filter and the capacitance of the actuators.

As is obvious from the Formula (1), the transfer function T(s) of the filter, namely the frequency characteristic thereof varies in accordance with the number $N_{NZL}$, of actuators 22 to be driven. FIG. 10 shows an example of the frequency characteristic of the filter. The target characteristic in the drawing corresponds to the frequency characteristic of the low pass filter 29 set when driving a half of all of the actuators 22, and the gain is set to be 0 dB in the entire output frequency range of the drive signal COM (the drive pulses PCOM). In other words, although the power-amplified modulated signal APWM is not attenuated nor emphasized in this output frequency range, the modulation frequency component is particularly attenuated in the frequency range higher than this output frequency range. With respect to this target characteristic, when the number of actuators 22 to be driven is larger ("larger number of driven nozzles" in FIG. 10), the characteristic of the high frequency attenuation filter varies so that the cutoff frequency thereof is shifted toward the lower frequency. In contrast, when the number of actuators 22 to be driven is smaller ("smaller number of driven nozzles"), the cutoff frequency is shifted toward the higher frequency, thus a characteristic with a peak is obtained.

Figure 11A:
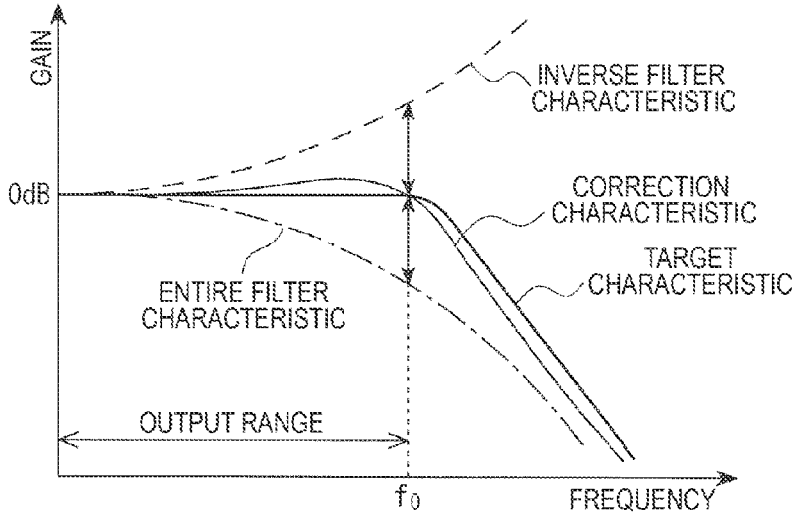
FIGS. 11A and 11B are explanatory diagrams of the frequency characteristic varying due to the inverse filter.
Figure 11B:
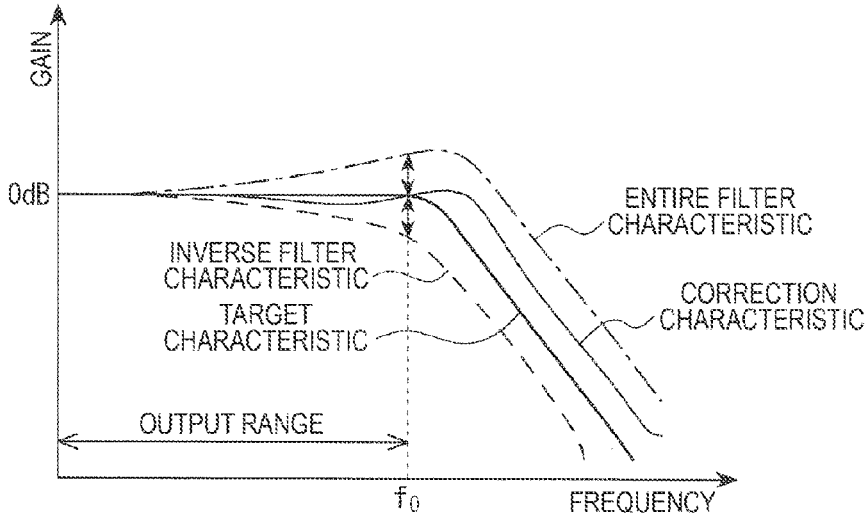

When the cutoff frequency is shifted toward, for example, the lower frequency as shown in FIG. 11A with respect to such a frequency characteristic of the filter constituted with the low pass filter 29 and the capacitance of the actuators 22 to be driven, namely when the number of actuators 22 to be driven is larger than a predetermined number, the inverse filter circuit 24 is used with the transmission characteristic thereof switched to a phase lead characteristic. Thus, it becomes possible to adjust the magnification ratio A of the amplifier 33 so that the gain becomes 0 dB at the highest frequency f0 of the output frequency range of the drive signal COM (the drive pulses PCOM), thereby making the frequency characteristic thus corrected closer to the target characteristic. In contrast, when a peak is caused in the frequency characteristic as shown in FIG. 11B, namely when the number of actuators 22 to be driven is smaller than the predetermined number, the inverse filter circuit 24 is used with the transmission characteristic thereof switched to a phase lag characteristic. Thus, it becomes possible to adjust the magnification ratio A of the amplifier 33 so that the gain becomes 0 dB at the highest frequency f0 of the output frequency range of the drive signal COM (the drive pulses PCOM), thereby making the frequency characteristic thus corrected closer to the target characteristic.

Figure 12A:
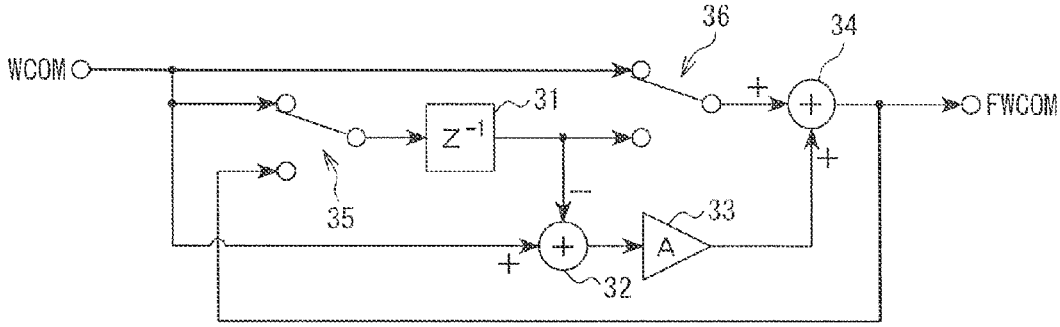
FIGS. 12A and 12B are explanatory diagrams of a switching operation in the inverse filter circuit shown in FIG. 7.
Figure 12B:
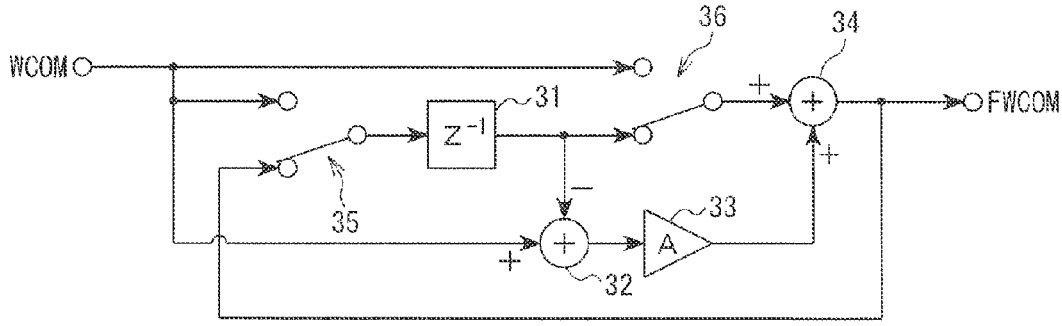

FIGS. 12A and 12B are diagrams showing only the filter function extracted from the inverse filter circuit 24. As described above, when coupling the first switch 35 to the drive waveform signal WCOM, the second switch 36 is also coupled to the drive waveform signal WCOM, and therefore, the circuit state at that moment becomes as shown in FIG. 12A. The circuit state shown in FIG. 12A corresponds to the case of using the inverse filter circuit 24 with the transmission characteristic switched to the phase lead characteristic. In contrast, when coupling the first switch 35 to the output of the adder 34, the second switch 36 is coupled to the output of the delay device 31, and therefore, the circuit state at that moment becomes as shown in FIG. 12B. The circuit state shown in FIG. 12B corresponds to the case of using the inverse filter circuit 24 with the transmission characteristic switched to the phase lag characteristic.

Figure 13A:
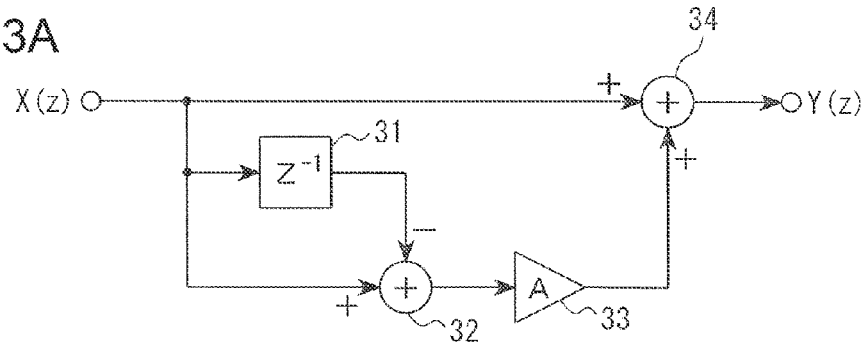
FIGS. 13A through 13C are explanatory diagrams of the inverse filter shown in FIG. 12A.
Figure 14A:
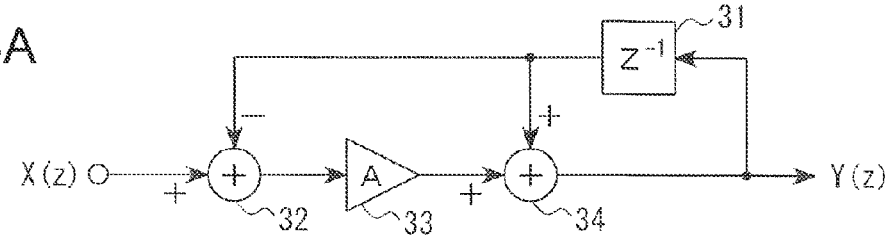
FIGS. 14A through 14C are explanatory diagrams of the inverse filter shown in FIG. 12B.

FIG. 13A is a block diagram obtained by removing the switches and superfluous wiring from FIG. 12A. FIG. 14A is a block diagram obtained by removing the switches and superfluous wiring from FIG. 12B. As is obvious from the both drawings, in FIG. 13A the delay device 31 is coupled as a parallel circuit to the input signal X(z). In contrast, in FIG. 14A the delay device 31 is coupled as a feedback circuit to the input signal X(z). In other words, in the both drawings the connection state of the delay device 31 is switched. Further, in FIG. 13A, the subtracter 32 subtracts the output of the delay device 31 from the input signal X(z), the amplifier 33 multiplies the result by A, and then the adder 34 adds the result to the input signal X(z). Therefore, the transmission characteristic of this filter is expressed by the Formula (2) below.

$$G(z)=I+A\cdot(1-z^{-1}) \quad (2)$$

If the sampling frequency fs (the inverse of the sampling period Ts) in the discrete system obtained by the Formula (2)

is sufficiently higher than the highest frequency f0 of the output frequency range, the Laplace operator "s" can be expressed in a discretized form shown in Formula (3) below.

$$s = \frac{(1 - z^{-1})}{T_s} \tag{3}$$

Therefore, by substituting the Formula (3) in the Formula (2), the Formula (4) below can be obtained as the transfer function of the filter circuit shown in FIG. 13A.

$$G(s)=1+A\cdot T_S\cdot s \tag{4}$$

Figure 13B:
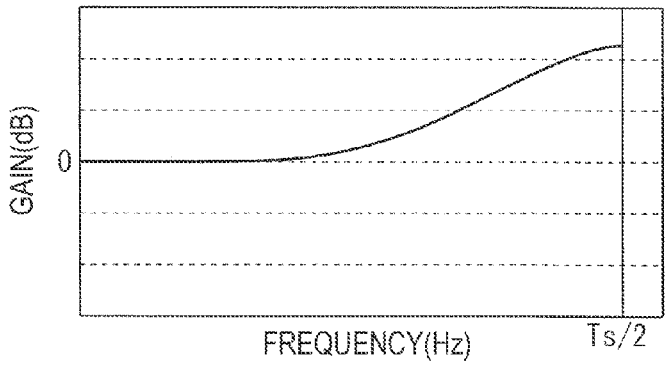
Figure 13C:
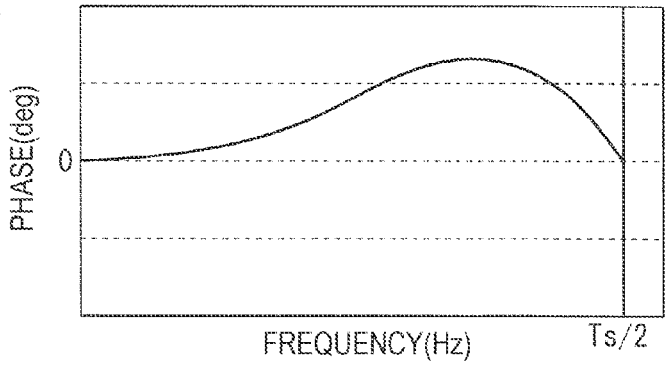

The transfer function expressed in the Formula (4) corresponds to the filter showing the phase lead characteristic well known to the public, and it is also possible to control the gain and the phase by controlling the magnification ratio A of the amplifier 33 in the formula. FIG. 13B shows an example of the frequency characteristic of the gain of the filter shown in FIG. 13A, and FIG. 13C shows an example of the frequency characteristic of the phase thereof.

In contrast, in FIG. 14A the delay device 31 delays the output signal Y(z), the subtracter 32 subtracts the result from the input signal X(z), the amplifier 33 multiplies the result by A, and the adder 34 adds the output of the delay device 31 to the resulting signal, thereby obtaining the output signal Y(z). Therefore, the transmission characteristic of this filter is expressed by the Formula (5) below.

$$G(z) = \frac{1}{z^{-1} + \frac{(1 - z^{-1})}{A}} \tag{5}$$

By substituting the Formula (3) in the Formula (5), the Formula (6) below can be obtained.

$$G(s) = \frac{1}{z^{-1} + \frac{T_s}{A}s} \tag{6}$$

If the sampling frequency fs in the discrete system obtained by the Formula (6) is sufficiently higher than the highest frequency f0 of the output frequency range, namely assuming that the sampling period Ts is sufficiently short, z−1=1 is satisfied. Therefore, by substituting this expression to the Formula (6) described above, the filter transmission characteristic expressed by the Formula (7) below can be obtained.

$$G(s) = \frac{1}{1 + \frac{T_s}{A}s} \tag{7}$$

Figure 14B:
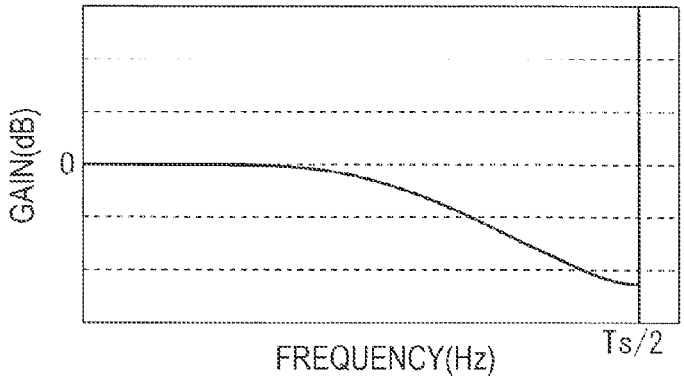
Figure 14C:
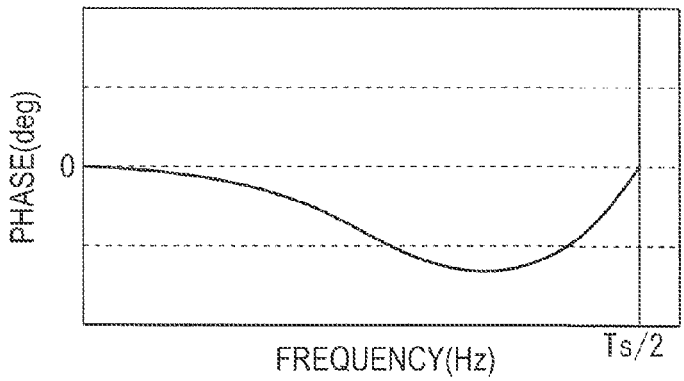

The transfer function expressed in the Formula (7) corresponds to the filter showing the phase lag characteristic well known to the public, and it is also possible to control the gain and the phase by controlling the magnification ratio A of the amplifier 33 in the formula. FIG. 14B shows an example of the frequency characteristic of the gain of the filter shown in FIG. 14A, and FIG. 14C shows an example of the frequency characteristic of the phase thereof.

The target characteristic shown in FIG. 10 is set assuming, for example, that the number of actuators 22 to be driven is a half of all of the actuators 22, and the transmission characteristic T(s) of the filter shows the phase lag characteristic when the number of actuators 22 to be driven is larger, and shows the phase lead characteristic when the number of actuators 22 to be driven is smaller. Defining the number of driven actuators when setting the target characteristic as a reference driven actuator count, it is possible to set the filter characteristic of the inverse filter circuit 24 to be the phase lead characteristic, namely to couple the first switch 35 to the drive waveform signal WCOM and at the same time to couple the second switch 36 also to the drive waveform signal WCOM when the number of driven actuators is larger than the reference driven actuator count. In contrast, it is possible to set the filter characteristic of the inverse filter circuit 24 to be the phase lag characteristic, namely to couple the first switch 35 to the output of the adder 34 and at the same time to couple the second switch 36 to the output of the delay device 31 when the number of driven actuators is smaller than the reference driven actuator count. Further, as described above, each of the phase lead transmission characteristic and the phase lag transmission characteristic of the inverse filter circuit 24 can be separately controlled by the magnification ratio A of the amplifier 33. For example, in the case in which the inverse filter circuit 24 is built with a program, by controlling the magnification ratio A in accordance with the difference of the number of driven actuators from the reference driven actuator count, it is possible to make the frequency characteristic of the drive signal output system corrected by the inverse filter circuit 24 come closer to the target characteristic.

As described above, according to the fluid ejection device of the present embodiment, in the case in which the modulator 26 pulse-modulates the drive waveform signal WCOM forming the basis of the drive signal COM of the actuators 22 for ejecting the fluid, the digital power amplifier 28 power-amplifies the modulated signal pulse-modulated by the modulator 26, and the low pass filter 29 filters the power-amplified modulated signal power-amplified by the digital power amplifier 28 to supply the actuators 22 with the power-amplified modulated signal as the drive signal COM, there is disposed in the anterior stage of the modulator 26 the inverse filter circuit 24 capable of obtaining a desired drive signal COM even when the frequency characteristic of the filter composed at least of a low pass filter 29 and the capacitance of the actuators 22 varies in accordance with the number of actuators 22 to be driven, the inverse filter circuit 24 being provided with the delay device 31, the subtracter 32 for subtracting the output of the delay device 31 from the drive waveform signal WCOM, the amplifier 33 for multiplying the output of the subtracter 32 by a predetermined magnification ratio A, the adder 34 for adding the output of the amplifier 33 to the other input, the first switch 35 for switching the drive waveform signal WCOM and the output of the adder 34 to form the input of the delay device 31, and the second switch 36 for switching the drive waveform signal WCOM and the output of the delay device 31 to form the other input of the adder 34 disposed therein, and the connection state of the delay device 31 is switched by the first and second switches 35, 36 to thereby switch the transmission characteristic of the inverse filter circuit 24 between the phase lead characteristic and the phase lag characteristic thereby making it possible to reduce the circuit scale of the inverse filter and to obtain a desired drive signal COM with a simple and easy configuration.

Further, since the switch connection control section 37 is arranged to couple the second switch 36 to the drive waveform signal WCOM when coupling the first switch 35 to the drive waveform signal WCOM, and to couple the second switch 36 to the output of the delay device 31 when coupling the first switch 35 to the output of the adder 34, it is possible to accurately switch the transmission characteristic of the inverse filter circuit 24 between the phase lead characteristic and the phase lag characteristic.

Further, the switch connection control section 37 is arranged to control the magnification ratio A of the amplifier 33 in accordance with the number of actuators 22 to be driven, it becomes possible to further improve the waveform accuracy of the drive signal COM.

It should be noted that although in the present embodiment described above only the case in which the fluid ejection device of the invention is applied to the line head-type fluid ejecting recording device is described in detail, the fluid ejection device of the invention can also be applied to multi-pass type fluid ejecting recording device in a similar manner.

Further, the fluid ejection device of the invention can also be embodied as a fluid ejection device for ejecting a fluid (including a fluid like member dispersing particles of functional materials, and a fluid such as a gel besides fluids) other than the ink, or a fluid (e.g., a solid substance capable of flowing as a fluid and being ejected) other than fluids. The fluid ejection device can be, for example, a fluid ejection device for ejecting a fluid including a material such as an electrode material or a color material used for manufacturing a liquid crystal display, an electroluminescence (EL) display, a plane emission display, or a color filter in a form of a dispersion or a solution, a fluid ejection device for ejecting a living organic material used for manufacturing a biochip, or a fluid ejection device used as a precision pipette for ejecting a fluid to be a sample. Further, the fluid ejection device can be a fluid ejection device for ejecting lubricating oil to a precision machine such as a timepiece or a camera in a pinpoint manner, a fluid ejection device for ejecting on a substrate a fluid of transparent resin such as ultraviolet curing resin for forming a fine hemispherical lens (an optical lens) used for an optical communication device, a fluid ejection device for ejecting an etching fluid of an acid or an alkali for etching a substrate or the like, a fluid ejection device for ejecting a gel, or a fluid ejection recording apparatus for ejecting a solid substance including fine particles such as a toner as an example. Further, the invention can be applied to either one of these ejection devices.

What is claimed is:

1. A fluid ejection device comprising:

a modulator which pulse-modulates a drive waveform signal to obtain a modulated signal;

a digital power amplifier which power-amplifies the modulated signal to obtain a power-amplified modulated signal;

a low pass filter which filters the power-amplified modulated signal to obtain a drive signal that drives a plurality of actuators; and an inverse filter circuit, wherein the inverse filter circuit includes a delay device, a subtracter which subtracts an output signal of the delay device from the drive waveform signal, an amplifier which amplifies an output signal of the subtracter at a predetermined magnification ratio, an adder which adds an output signal of the amplifier and an input signal to the adder, a first switch which selects either one of the drive waveform signal or an output signal of the adder as an input signal to the delay device, a second switch which selects either one of the drive waveform signal or the output signal of the delay device as the input signal to the adder, and a switch connection control section which controls the first switch and the second switch.

2. The fluid ejection device according to claim 1, wherein the switch connection control section couples the first switch to the drive waveform signal and couples the second switch to the drive waveform signal if a number of the actuators to be driven is equal to or larger than a predetermined number, and the switch connection control section couples the first switch to the output signal of the adder and couples the second switch to the output signal of the delay device if the number of the actuators to be driven is smaller than the predetermined number.

3. The fluid ejection device according to claim 1, wherein the amplifier controls an amplification ratio in accordance with the number of actuators to be driven.

4. A fluid ejection device comprising:

a first filter circuit which applies a desired filter to a drive waveform signal;

a modulator which pulse-modulates a filtered signal filtered by the first filter circuit to form a modulated signal;

a digital power amplifier which power-amplifies the modulated signal to obtain a power-amplified modulated signal; and a second filter circuit which filters the power-amplified modulated signal to form a drive signal, wherein the first filter circuit includes a delay device, a subtracter which subtracts an output signal of the delay device from the drive waveform signal, an amplifier which amplifies an output signal of the subtracter at a predetermined magnification ratio, an adder which adds either the drive waveform signal or the output signal of the delay device to an output signal of the amplifier, a first switch which inputs either the drive waveform signal or an output signal of the adder to the delay device, and a second switch which inputs either the drive waveform signal or the output signal of the delay device to the adder.

5. The fluid ejection device according to claim 4, wherein the first filter circuit makes the delay device input the drive waveform signal using the first switch and makes the adder input the drive waveform signal using the second switch if a number of actuators to be driven is equal to or larger than a predetermined number.

6. The fluid ejection device according to claim 4, wherein the first filter circuit makes the delay device input the output signal of the adder using the first switch and makes the adder input the output signal of the delay device using the second switch if the number of actuators to be driven is smaller than a predetermined number.

7. The fluid ejection device according to claim 4, wherein the first filter circuit applies the desired filter by emphasizing a predetermined high-frequency band if a number of actuators to be driven is equal to or larger than a predetermined number.

8. The fluid ejection device according to claim 4, wherein the first filter circuit applies the desired filter by attenuating a predetermined high-frequency band if a number of actuators to be driven is smaller than a predetermined number.

9. A fluid ejecting recording device comprising:

the fluid ejection device according to claim 4.

* * * * *